US007374361B1

(12) United States Patent
Kwon

(10) Patent No.: US 7,374,361 B1
(45) Date of Patent: May 20, 2008

(54) COSMETIC CASE CAPABLE OF BLOCKING NOZZLE TIP AIR TIGHTLY

(76) Inventor: HyukTark Kwon, A-3602, Samsung Chervill 1 Apt., 318-10, Sinjeong-dong, Yangcheon-gu, Seoul, 158-762 (KR)

( * ) Notice: Subject to any disclaimer, the term of this patent is extended or adjusted under 35 U.S.C. 154(b) by 0 days.

(21) Appl. No.: 11/638,118

(22) Filed: Dec. 13, 2006

(30) Foreign Application Priority Data

Dec. 8, 2006 (KR) ..... 10-2006-0124937

(51) Int. Cl.
*B43K 1/06* (2006.01)
*B43K 23/12* (2006.01)
*B43K 5/00* (2006.01)
*A46B 17/04* (2006.01)

(52) U.S. Cl. ..... 401/265; 401/262; 401/202; 401/269

(58) Field of Classification Search ..... 401/262, 401/263, 265, 266, 270, 277, 280, 281, 202, 401/205, 269
See application file for complete search history.

(56) References Cited

U.S. PATENT DOCUMENTS 4,844,250 A * 7/1989 Holoubek et al. ..... 222/107
5,454,660 A * 10/1995 Sakurai et al. ..... 401/266
7,192,212 B2 * 3/2007 Gutberlet et al. ..... 401/174

* cited by examiner

*Primary Examiner*—David J. Walczak
(74) *Attorney, Agent, or Firm*—Ladas & Parry LLP

(57) ABSTRACT

A cosmetic dispenser including a container, a dispensing part connected to the container through a connecting part, and a cap removably covering the dispensing part. The cap is rotatable to rotate the dispensing part therewith thereby moving the dispensing part between a closed position in which a switching pole of the connecting part blocks an opening inside the dispensing part, and an open position in which the opening is moved away from the switching pole and the content stored inside the container is able to be transmitted to the dispensing part.

8 Claims, 10 Drawing Sheets

COSMETIC CASE CAPABLE OF BLOCKING NOZZLE TIP AIR TIGHTLY

CROSS-REFERENCE TO RELATED PATENT APPLICATIONS

This application claims the benefit of Korean Patent Application No. 10-2006-0124937, filed on 8 Dec. 2006, in the Korean Intellectual Property Office, the disclosure of which is incorporated herein in its entirety by reference.

BACKGROUND OF THE INVENTION

1. Field of the Invention

The present invention relates to a cosmetic case for containing an oily or watery tint-care cosmetic, more particularly, to a cosmetic case having a content transmitting path to a nozzle tip for discharging a cosmetic contained in a container and for rubbing the discharged cosmetic to a desired portion of the skin. The nozzle tip may be closed or opened in accordance with covering or uncovering of a cap, which also protects the nozzle tip from being loosened when dispensing the cosmetic.

2. Description of the Related Art

For the purpose of skin protection of beauty, ladies usually makeup with a tint-care cosmetic such as foundation, lipstick/lip gloss, eye cream, eye gel, ball touch, concealer, etc, after makeup with a skin-care cosmetic.

Not only appropriate structure of a container for maintaining the tint-care cosmetic differs from each other according to the usage and the component of the tint-care cosmetic but also the way how to makeup differs from each other according to the structure of the container.

There is one type of tint-care cosmetic for which a separate instrument for example, a powder puff, is used to makeup while there is another type which is contained in a container, is discharged through a nozzle and then rubbed on a desired portion of the skin by using the nozzle tip to makeup.

For example, tint-care cosmetics that are rubbed on a desired portion of the skin to makeup include lipstick, lip gloss, foundation, eye cream, etc, can be referred to.

Because those tint-care cosmetics are of oily gel type, it is possible to makeup by rubbing discharged tint-care cosmetic through the nozzle tip on the skin directly. Also because the discharged tint-care cosmetic is rubbed on the skin when performing makeup, not only it can permeate through the skin easily but also an effective makeup can be performed even with a small amount.

Because those tint-care cosmetic to be rubbed on the skin when makeup, including lipstick, lip gloss, ball touch, foundation, eye cream, eye gel, etc, are of oily gel type, it is preferable to prevent oil component from evaporating and to prevent the contained tint-care cosmetic in the container from contacting with the air.

In a conventional tube-type cosmetic case that discharges an oily gel-type tint-care cosmetic through a nozzle tip, a switching pole which is provided at the inside bottom portion of a cap is inserted into a discharging hole of the nozzle tip so that the content is blocked from being contacted with the air and an oily component of the content is blocked from being evaporated.

However, in such a conventional tube-type cosmetic case the switching pole may be bent and break if the pole is not aligned properly and inserted into the discharging hole when putting the cap on.

If the switching pole, which is provided at the inside bottom of the cap, is broken, it becomes impossible to block the discharging hole. Thus, air can be introduced into the container where the tint-care cosmetic is contained so that the tint-care cosmetic becomes hardened because the oily component which is contained in the tint-care cosmetic can evaporate.

Further, if the discharging hole remains open due to the broken switching pole, various problems can happen. For example, the content can spill out from the container when the container is pressed by an outer force or the container is placed upside down, the inside of the cap can become dirty with the discharged content, the unnecessarily discharged content becomes useless if it gets hardened, etc.

Further in the conventional cosmetic case with the nozzle tip, an opening portion of the container is deformed easily by the shock from the outside because the container, in which content is contained, is made by a soft tube in order that the content can be discharged easily through the nozzle tip.

If the nozzle tip is loosened from the container, air can be introduced through a connecting part and oily component of the content can evaporate thereby the content becomes hardened. Further the content can leak out from the container thereby the leaked content can stick to articles in the carrying bag and the interior of the carrying bag can become dirty.

To solve the problems of the conventional tube-type cosmetic case as described above, the applicant of the present invention have disclosed a cosmetic case capable of blocking outside air from being contacted to the oily gel-type tint-care cosmetic, which is contained in the container, so that not only the problem that the tint-care cosmetic gels harden but also other problems those can be occurred due to the opened discharging hole of the nozzle tip can be solved through the Korean registered utility invention No. 385091.

The registered invention has a container, in which the content is contained, a content outlet which is located at the opening part of the case through of an outer body, a switching adjustment part having a switching knob which is provided to open or close the content outlet selectively, an outer body on which a nozzle tip is provided at the upper portion and which is assembled to the outside of the switching adjustment part, and a cap to press the switching knob, which is protruded from the side of the outer body, in order to block the content outlet.

The registered invention opens or closes the content outlet selectively by the cap which is separated or installed with respect to the container.

If the cap is installed to the container, the switching knob of the switching adjustment part at the inside of the cap is restrained to close up inwardly so that a pressing pole of the switching knob presses the content outlet to be blocked.

Thus, the tint-care cosmetic in the case is protected from being contacted with the air and from becoming hardened.

When makeup using the tint-care cosmetic which is contained in the case stably, because the content outlet is blocked, the cap should be separated from the cosmetic case.

If the cap is separated from the cosmetic case, the switching knob of the switching adjustment part, which has been pressed by the inside of the cap, is set to free and the pressing pole is detached from the content outlet because the switching knob is protruded by the inherent elastic force.

If the pressing pole of the switching knob is detached, the content outlet is restored to an original state to open the content transmitting path because it is made by an elastic material (for example, rubber).

If the content transmitting path of the content outlet is opened, the content which is contained in the cosmetic case can be discharged through the nozzle tip and makeup can be performed by rubbing the discharged content to the desired portion of the skin with the nozzle tip.

When discharging the content in the container through the nozzle tip, the content is discharged from the nozzle tip with the cosmetic case placed upside down.

When the container is of a soft tube-type capable to press to discharge, the content is discharged by pressing the container.

After finishing makeup, the content outlet is blocked with the cap covered over the nozzle tip to maintain.

The registered invention is advantages in that the oily gel-type tint-care cosmetic can be used stably because the air is protected from being introduced into the inside of the cosmetic case where the tint-care cosmetic is contained. However, large number of the parts of the nozzle tip reduces productivity according to an assembling process and causes the cost increased.

Thus, it is necessary to simplify the structure in order to reduce the cost as well as to perform airtight process stably.

SUMMARY OF THE INVENTION

An object of the present invention is to provide a cosmetic case capable of solving the problem that the oily or watery tint-care cosmetic is unnecessarily leaked out and hardened when it is carried or maintained.

Another object of the present invention is to provide a cosmetic case capable of improving credibility of product because it can make the customer who uses the product feel the sense that he/she felt at first purchase without evaporation of the oily or watery component by effectively blocking the content in the container from being contacted with the air.

Still another object of the present invention is to provide a cosmetic case capable of improving productivity in accordance with assembly process by simplifying the structure of the nozzle tip and reduction of the cost can be also expected accordingly.

Still another object of the present invention is to provide a cosmetic case capable of improving the durability of the opening portion 31 by installing ratchet projection 33 at the opening portion 31 of the soft tube type container 30.

Still another object of the present invention is to provide a cosmetic case capable of protecting the content from becoming harden due to contact with the air or evaporation of the oily or watery component because the elastic ratchet projection 16, which is provided on the connecting part 23 of the nozzle tip 20, is engaged with the ratchet projection 33, which are provided on the opening portion 31, so that loosening cannot happen even if a rotating force in the screw-loosening direction at the installed nozzle tip 20 is applied.

Still another object of the present invention is to provide a cosmetic case capable of improving consumer's credibility of the cosmetic case with the nozzle tip because the content is protected from being leaked to lose and the interior of a carrying case is protected from getting dirty as the leaked content sticks to other articles.

The cosmetic case according to the present invention includes a container 30 whose opening portion 31 for discharging the contained content is formed in layers, a thread is provided on a lower outer circumference portion so that a nozzle tip connecting part 10 can be installed by screwing and a ratchet projection 33 is provided on an upper circumference portion; a nozzle tip connecting part 10 where an elastic ratchet projection 16, which is supported in the screw-loosening direction with respect to the ratchet projection 33 of the container 30, is provided in parallel with the outer side of a content path 15; a spiral guiding rail 41 which ensures a nozzle tip 20 elevated upwardly or downwardly is provided and a spiral supporting rail 12 is provided in parallel over the spiral guiding rail 11 on the outer circumference portion; and a switching pole 13 is provided on the inner content transmitting path 15 through a rib 14; a nozzle tip 20 having a discharging tube 21 where a content transmitting path 22, which is connected to a discharging hole 22*a*, is provided inside; a connecting part 21 which is provided at the bottom portion of the discharging tube 21; an elevating rail 24, which is guided along a spiral guiding rail 11 and supported by a spiral supporting rail 12, is provided on the interior side of the connecting part 21; and a groove 27 which is provided on the outer circumference portion; and a cap 40 where a key projection 42 which is inserted into the groove 27 of the nozzle tip 20; and a guiding projection 41 which is guided along the cap closing guiding rail 17 of the nozzle tip connecting part 10 are provided.

Additional aspects and/or advantages of the present invention will be set forth in part in the description which follows and, in part, will be obvious from the description, or may be learned by practice of the invention.

BRIEF DESCRIPTION OF THE DRAWINGS

The above and other features and advantages of the present invention will become more apparent by describing in detail preferred embodiments thereof with reference to the attached drawings in which.

BRIEF DESCRIPTION OF NUMERALS IN DRAWINGS

Figure 1:
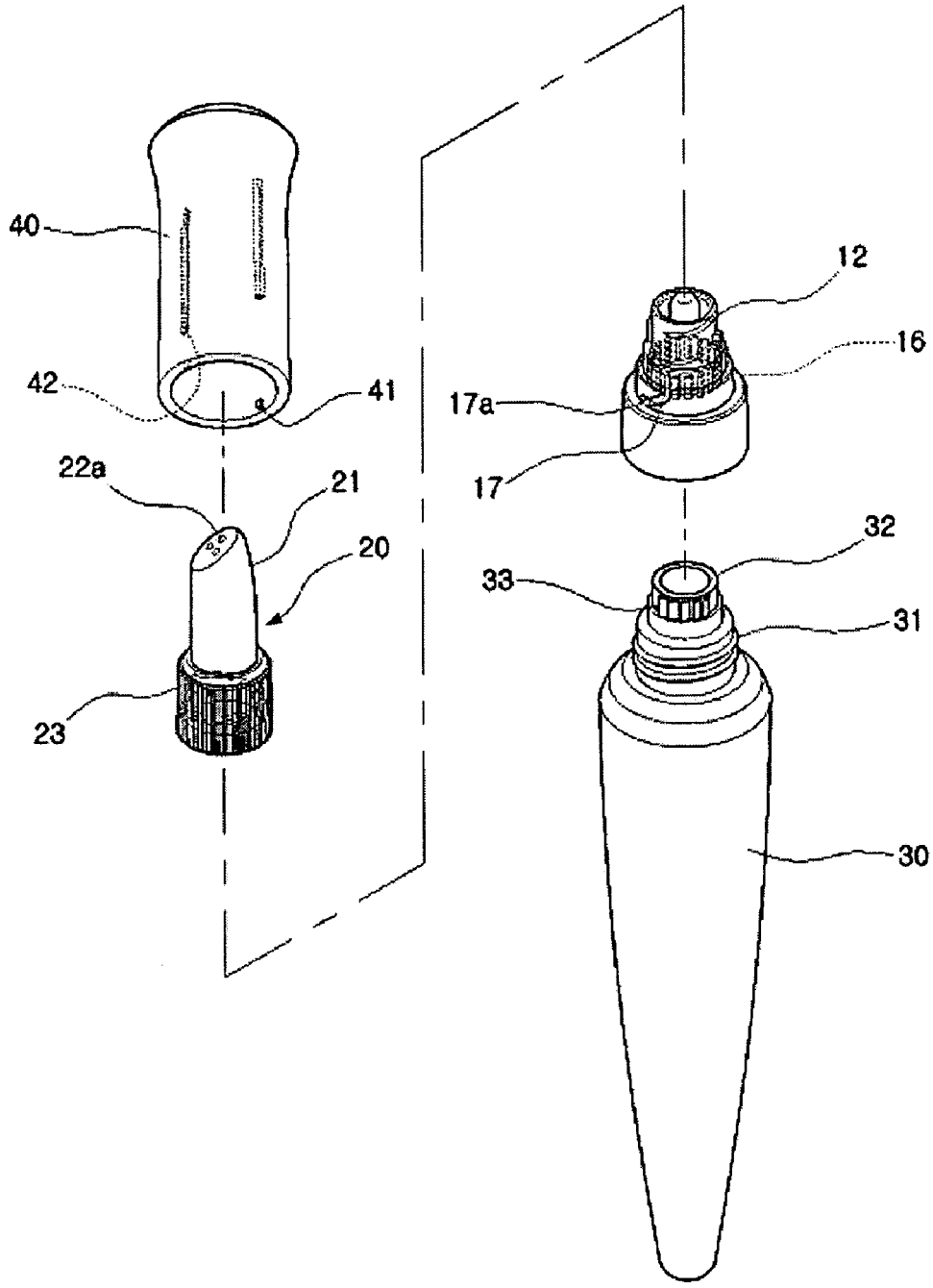
FIG. 1 is a disassembled perspective view illustrating a cosmetic case according to the present invention.
Figure 2:
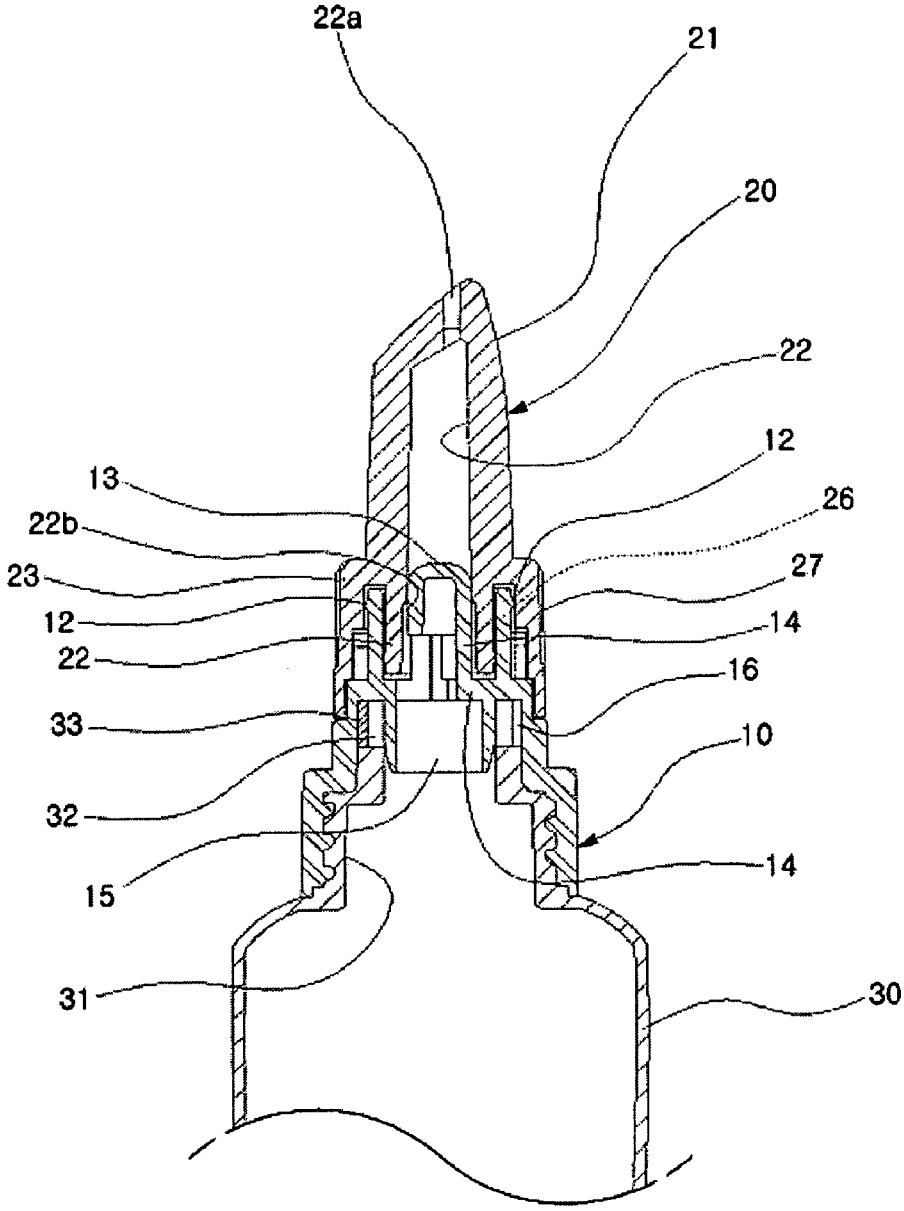
FIG. 2 is an assembled sectional view of the cosmetic case according to the present invention.
Figure 3:
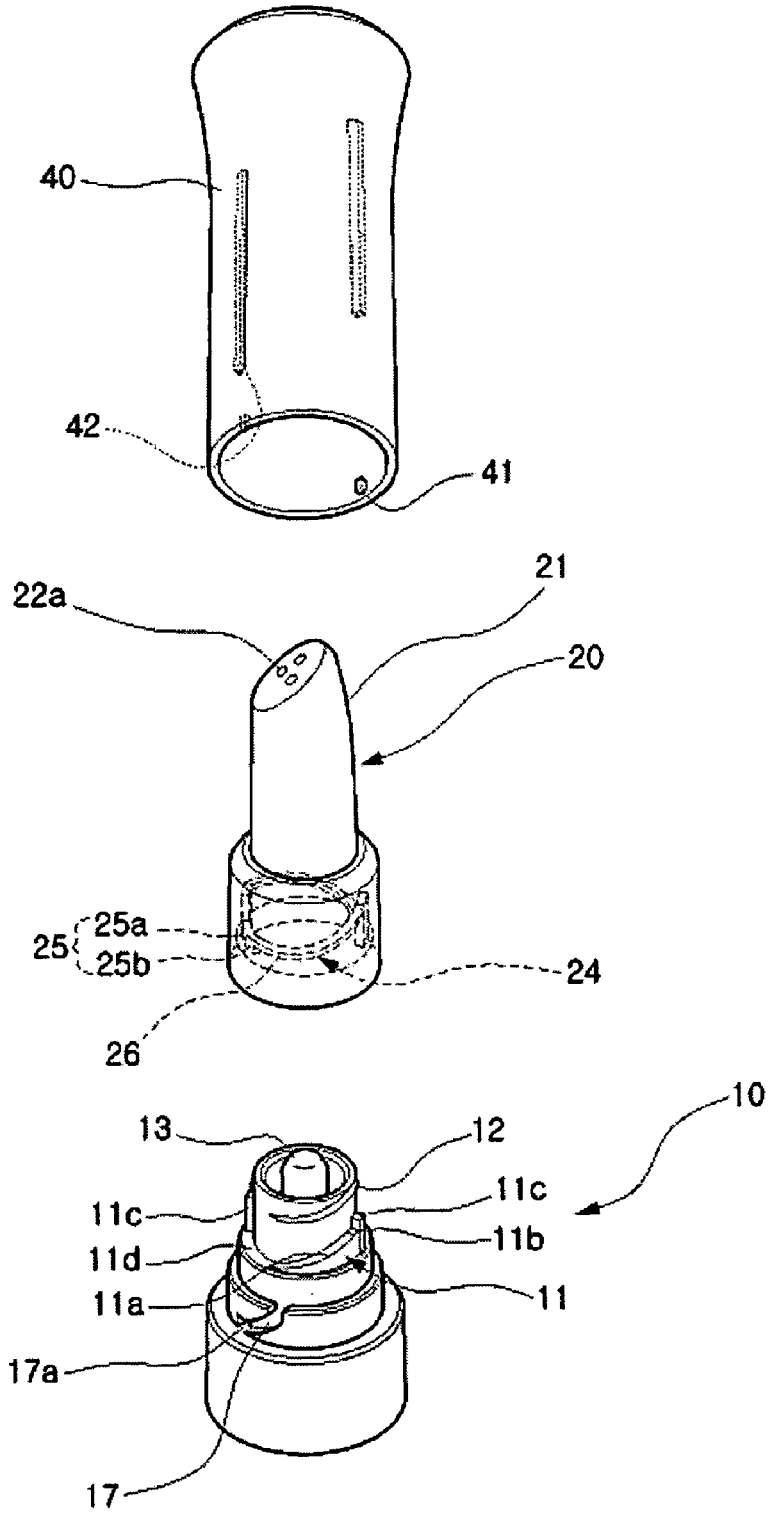
FIG. 3 is a disassembled perspective view of a nozzle of the cosmetic case according to the present invention, illustrating a supporting thread of a screw which is provided in a connecting part.
Figure 4:
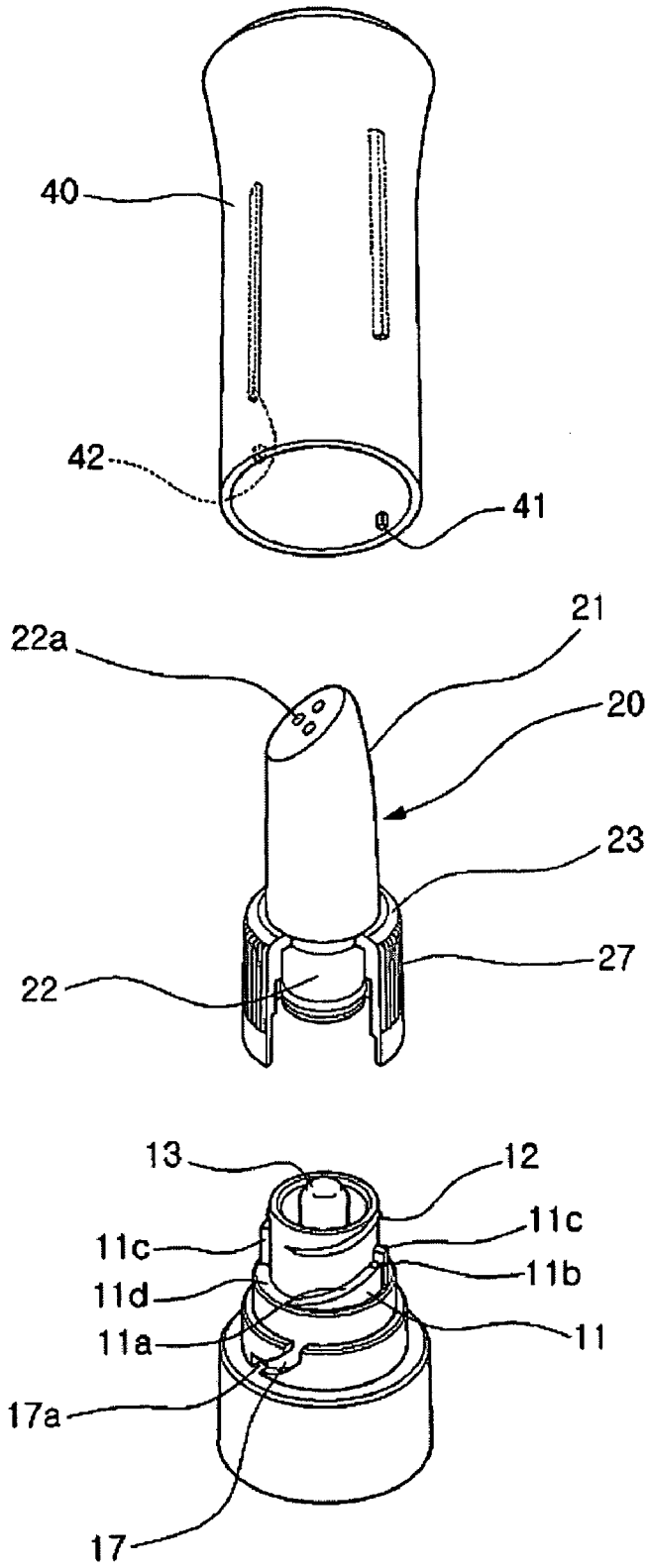
FIG. 4 is a disassembled perspective view illustrating a content transmitting tube of the nozzle tip of the cosmetic case according to the present invention.

| | | | |
|---|---|---|---|
| 10: | nozzle tip connecting part | 11: | spiral guiding rail |
| 11a: | tilted guiding side | 11b: | settling side |
| 11c: | stopper | 11d: | ledged side |
| 12: | spiral supporting rail | 13: | switching pole |
| 14: | rib | 15: | content transmitting path |
| 16: | elastic ratchet projection | 20: | nozzle tip |
| 17: | cap closing guiding rail | 17a: | locking groove |
| 21: | discharging tube | 22: | content transmitting tube |
| 22a: | discharging hole | 22b: | tube-widening portion |
| 23: | connecting part | 24: | elevating rail |
| 25: | guiding projection | 26: | supporting thread |
| 27: | groove | 30: | container |
| 31: | opening portion | 32: | upper circumference portion |
| 33: | ratchet projection | 40: | cap |
| 41: | guiding projection | 42: | key projection |

DETAILED DESCRIPTION OF THE INVENTION

Reference will now be made in detail to the embodiments of the present invention, examples of which are illustrated in the accompanying drawings, wherein like reference numerals refer to the like elements throughout. The embodiments are described below to explain the present invention by referring to the figures. For the sake of clearness and conciseness, technology related to the present invention that is not novel and is well known in the art to which present invention pertains will not be described herein.

As shown in FIG. 1 through FIG. 9, the cosmetic case according to the present invention has a container 30 in which the content is contained, a nozzle tip connecting part 10 which is installed to the opening portion of the container 30, a nozzle tip 20 which is installed to the nozzle tip connecting part 10 and elevates upwardly or downwardly, and a cap 40 to protect the nozzle tip 20.

The container 30 is of a soft tube-type so that the contained content is pressed to discharge and the opening portion 31 is formed in layers so that it can be classified into a larger external diameter and a smaller external diameter.

Threads are provided on the outer circumference portion with the larger external diameter of the opening portion 31 in order that the nozzle tip connection part 10 can be installed by screwing it onto the opening portion 31.

Further ratchet projection 33 is provided on both sides of the upper circumference portion 32 with the smaller outer diameter of the opening portion 31.

The ratchet projection 33 is formed in order that the nozzle tip connecting part 10 can be rotated toward a screw-tightening direction while it is prevented from being rotated toward a screw-loosening direction.

An elastic ratchet projection 16 is provided so that it can be climbed over the ratchet projection 33 of the opening portion 31 when the nozzle tip connecting part 10 is installed to the position neighboring to the outside of the content transmitting path 15 whilst it is engaged with the ratchet projection 33 of the opening portion 31 when a rotating force is applied to the opening portion 31 toward a screw loosening direction.

Basically, the elastic ratchet projection 16 performs a role to block the nozzle tip connecting part 10 from being rotated in the screw loosening direction. But the elastic ratchet projection 16 is configured to be modified elastically in order to climb over the ratchet projection 33 which are provided on the opening portion 31 of the container 30 when the nozzle tip connecting part 10 is rotated with a large force in the screw loosening direction.

Threads are provided on the inside of the nozzle tip connecting part 10 and a spiral guiding rail 11 is provided on the upper circumference portion 32 in order that it can be screwed to connect to the opening portion 31 of the container 30.

The spiral guiding rail 11 has a tilted guiding side 11*a*, which is protruded from the outer circumference portion in order to guide a elevating rail 24 of the nozzle tip 20, a setting side 11*b* on its upper portion, on which a shorter guiding projection 25*b* of guiding projection 25 of the elevating rail 24 of the nozzle tip 20 is settled, and a stopper 11*c*, which is protruded upwardly and restrains the movement of the longer guiding projection 25*b*, neighboring to the settling side 11*b*.

The spiral guiding rail 11 is formed on the outer circumference portion in opposite directions.

A spiral supporting rail 12 is provided on the upper portion of the spiral guiding rail 11. The upper portion of the elevating rail 24 of the nozzle tip 20 is supported to guide in the parallel direction with respect to the spiral guiding rail 11.

The spiral supporting rail 12 is formed on the outer circumference portion in opposite directions.

A switching pole 13 is provided on the content transmitting path, which is provided in the nozzle tip connecting part 10, through a rib 14. The switching pole 13 is inserted into the content transmitting path 22 of the nozzle tip 20 to switch the content transmitting path 22 selectively.

A cap closing guiding rail 17 is provided at the lower portion of the spiral guiding rail 11 of the nozzle tip connecting part 10 in opposite directions. The guiding projection 41 of the cap 40 is guided by the cap closing guide rail 17.

A camping groove 17*a* is provided at the lower portion of the cap closing guiding rail 17. The installment of the cap 40 is maintained by the cap closing guide rail 17.

The nozzle tip 20, which is installed to the nozzle tip connecting part 10, is configured with a discharging tube 21 and a connecting part 23.

The content transmitting path 22, by which the cosmetic is transmitted, is provided in the discharging tube 21 and the content transmitting path 22 is connected to the discharging hole 22*a*.

The content transmitting path 22 has a tube-widening portion 22*b* and the inner diameter of the tube-widening portion 22*b* is larger than the outer diameter of the switching pole 13 of the content transmitting path 22.

The connecting part 23 is provided at the lower portion of the discharging tube 21 and an elevating rail 24 is provided at the inner side of the connecting part 23.

The guiding projection 25 is provided at the bottom of the one end of the elevating rail 24 and the guiding projection 25 is guided to climb over the spiral guide rail 11 of the nozzle tip connecting part 10.

The guiding projection 25 has a shorter guiding projection 25*b* and a longer guiding projection 25*a*. The shorter guiding projection 25*b* is contacted tightly to the tilted guiding side 11*a* of the spiral guiding rail 11 and will be placed on the setting side 11*b* when the nozzle tip 20 is elevated upwardly until the content can be discharged to use. The a longer guiding projection 25*a* is supported on the ledged side 11*d* when the nozzle tip 20 is elevated downwardly until the content transmitting path 22 is blocked air tightly.

A supporting thread 26 is provided at the elevating rail 24. The supporting thread 26 is extended from the guiding projection 25 and supported to guide by the lower portion of the spiral supporting rail 12.

A groove 27 is provided on the outer circumference portion of the nozzle tip 20 so that a key projection 42 of the cap 40 is inserted.

The discharging tube 21 of the nozzle tip 20 can be replaced with one of brush, rubber, TEFLON (trademark of DuPont. Another name for "POLYTETRAFLUOROETHYLENE"), sponge, puff and flocking ball 21*a*.

The key projection 42, which is inserted into the groove 27 of the nozzle tip 20, and a guiding projection 41, which is guided along the cap closing guiding rail 17 of the nozzle tip connecting part 10, is provided on the inner side of the cap 40 which protects the nozzle tip 20.

When it is desired to discharge the tint-care cosmetic through the nozzle tip of the cosmetic case according to the present invention, the cap 40, which is covered to protect the nozzle tip 20, should be separated.

After then, content is discharged through the nozzle tip 20 to makeup.

Figure 5:
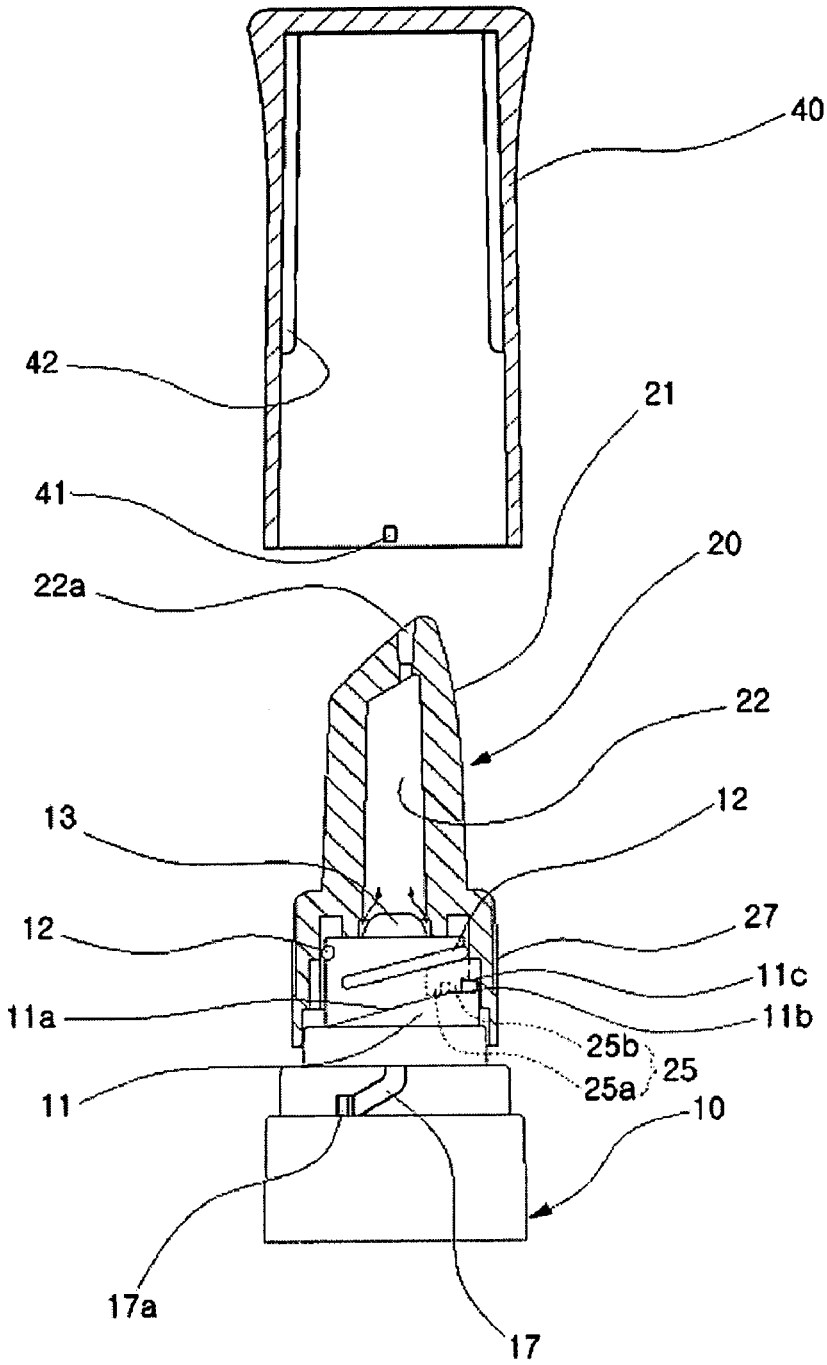
FIG. 5 is a sectional view illustrating the state that a content transmitting path is achieved in the cosmetic case according to the present invention.

FIG. 5 shows the state that the cap 40 is separated from the nozzle tip 20.

As shown in FIG. 5, the nozzle tip 20 is separated from the nozzle tip connecting part 10 when the nozzle tip rotates in the screw-loosening direction because the guiding projection 41 of the cap is guided along the cap closing guiding rail 17 of the nozzle tip connecting part 10 when the cap 40 is pulled out to separate.

The cap 40 and the nozzle tip 20 rotate together when the cap 40 is separated because the key projection 42 of the cap 40 is inserted into the groove 27 of the connecting part 23 of the nozzle tip 20.

The nozzle tip 20 is moved together in the screw-loosening direction by the rotating cap 40.

If the nozzle tip 20 rotates, the nozzle tip 20 is elevated upwardly because the shorter guiding projection 25*b* of the guiding projection 25 of the elevating rail 24, which is provided on the inner side of the connecting part 23 of the nozzle tip 20 in opposite directions, are guided along the tilted guiding side 11*a* of the spiral guiding rail 11 of the nozzle tip connecting part 10.

If the shorter guiding projection 25*b* of the elevating rail 24, which is provided at the nozzle tip 20, climbs on upwardly along the tilted guiding side 11*a* of the spiral guiding rail 11 of the nozzle tip connecting part 10, the switching pole 13, which has blocked the content transmitting path 22, is located at the tube-widening portion 22*b* so that the content transmitting path 22, through which the tint-care cosmetic can be discharged, is achieved as shown by an arrow in FIG. 5.

If the transmitting path is provided in the content transmitting tube 22, the shorter guiding projection 25*b* of the guiding projection 25 of the elevating rail 24 of the nozzle tip 20 is settled on the settling side 11*b* of the spiral guiding rail 11 of the nozzle tip connecting part 10 and contacted to the stopper 11*c* so that the nozzle tip cannot rotate any more.

In the meantime, the nozzle tip 20 can elevate upwardly stably without departing from the nozzle tip connecting part 10 when the elevating rail 24 of the nozzle tip 20 is guided toward the spiral guiding rail 11 of the nozzle tip connecting part 10 because the supporting thread 26 is guided toward the spiral supporting rail 12, which is provided at the upper portion of the spiral guiding rail 11.

If the content transmitting path 22 of the discharging tube 21 is opened as the nozzle tip 20 elevates upwardly, the content, which is contained in the container 30, can be discharged through the discharging hole 22, which is provided on the upper side of the discharging tube 21 of the nozzle tip 20, and then the discharged content can be rubbed to apply to the desired portion of the skin to makeup by using the nozzle tip 20.

The content of the container 30 can be discharged through the discharging hole 21*a* of the nozzle tip 20 when the case placed upside down.

If the case is of a soft tube-type, the content can be discharged by squeezing the case.

After makeup, the content in the container 30 should be maintained in order that the content should not be hardened by contacting with air.

For blocking the content from being contacted with the air, the nozzle tip 20, which is elevated upwardly, should be elevated downwardly.

To elevate the nozzle tip 20 downwardly, the nozzle tip 20 should be rotated in the screw-closing direction.

The nozzle tip 20 can be rotated in the screw-closing direction by covering the cap 40 over the nozzle tip 20.

The process to airtight the nozzle tip 20 by covering the cap 40 over the nozzle tip 20 will be described taken with accompanied drawings of FIG. 7 through FIG. 8.

Figure 6:
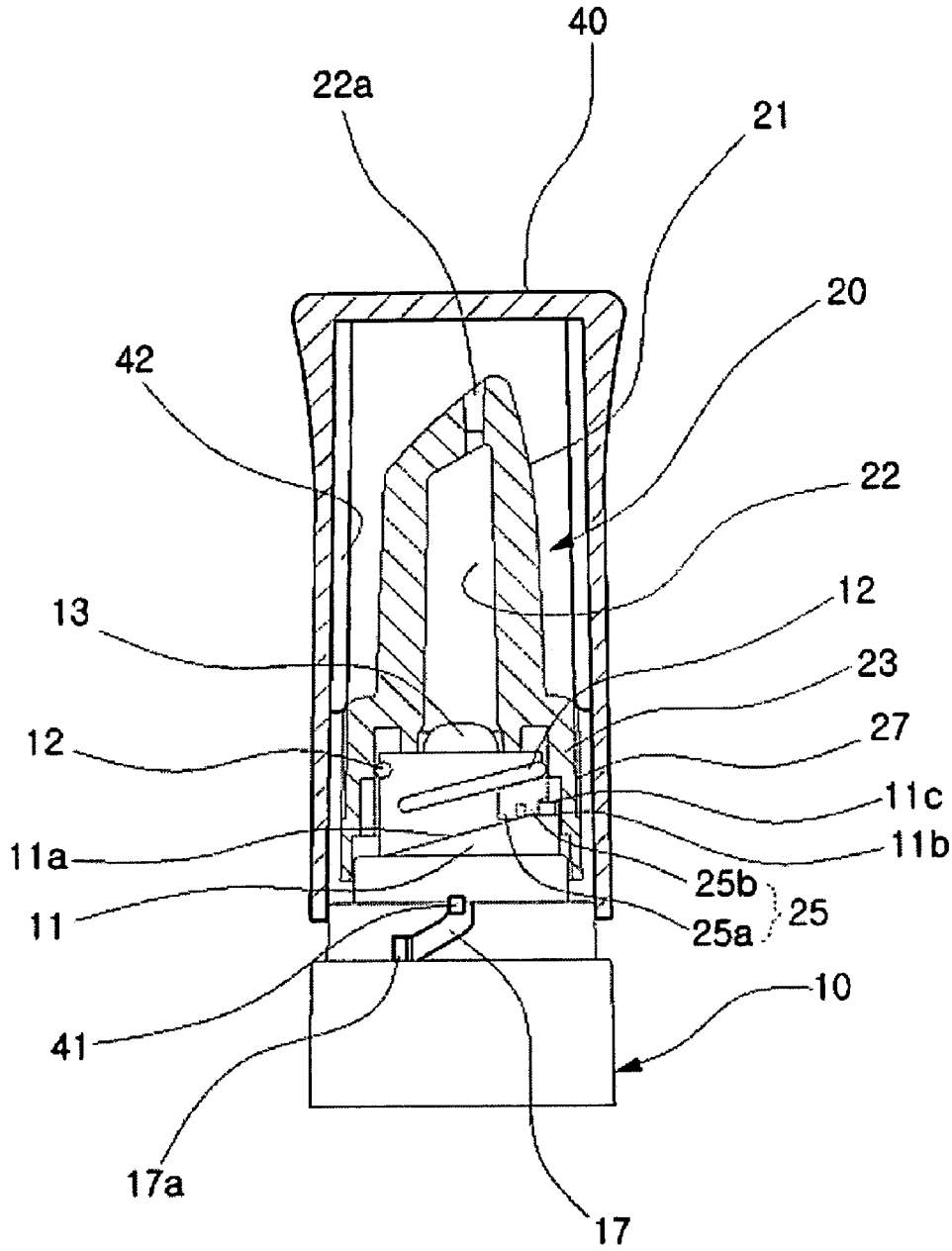
FIG. 6 is a sectional view illustrating the initial state of the process that blocks the transmitting path of the nozzle tip 20 in the cosmetic case according to the present invention.

FIG. 6 is a sectional view illustrating the initial state of the process that the transmitting path of the nozzle tip 20 is blocked in the cosmetic case according to the present invention.

Figure 7:
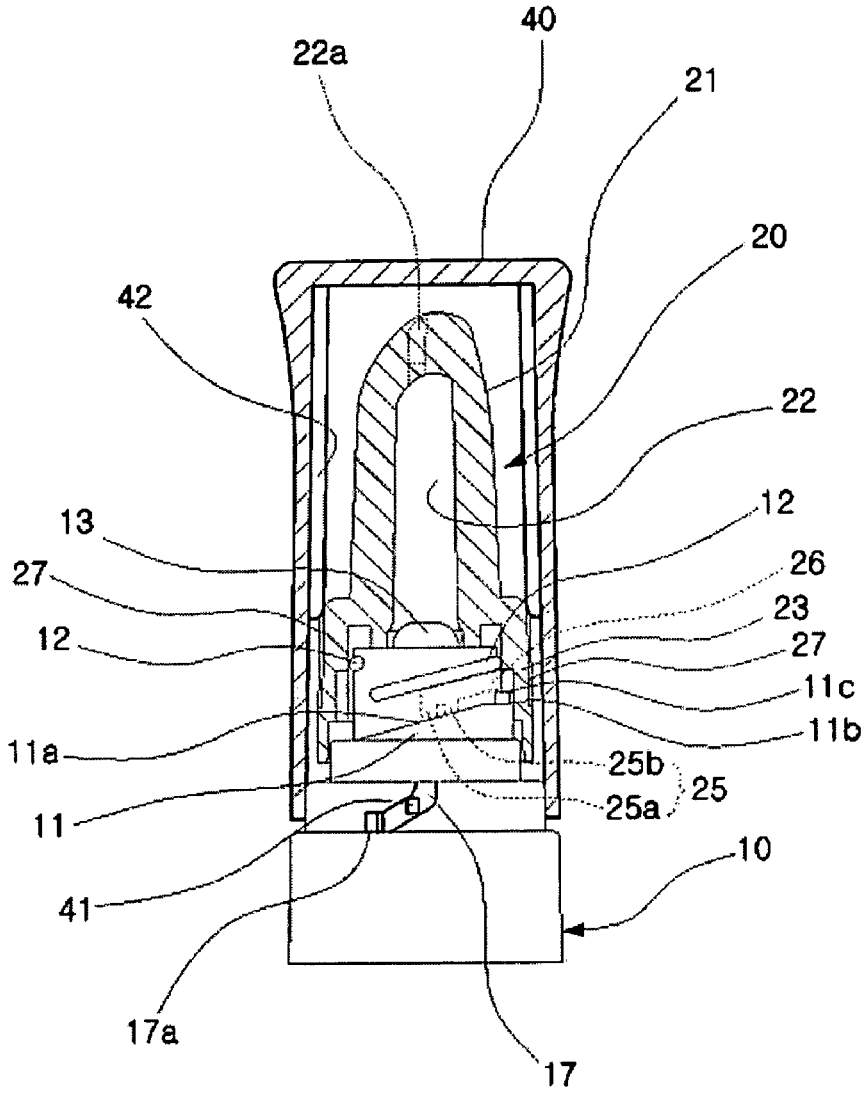
FIG. 7 is a sectional view illustrating the intermediate state of the process that blocks the transmitting path of the nozzle tip 20 in the cosmetic case according to the present invention.

FIG. 7 is a sectional view illustrating the intermediate state of the process that the transmitting path of the nozzle tip 20 is blocked in the cosmetic case according to the present invention.

Figure 8:
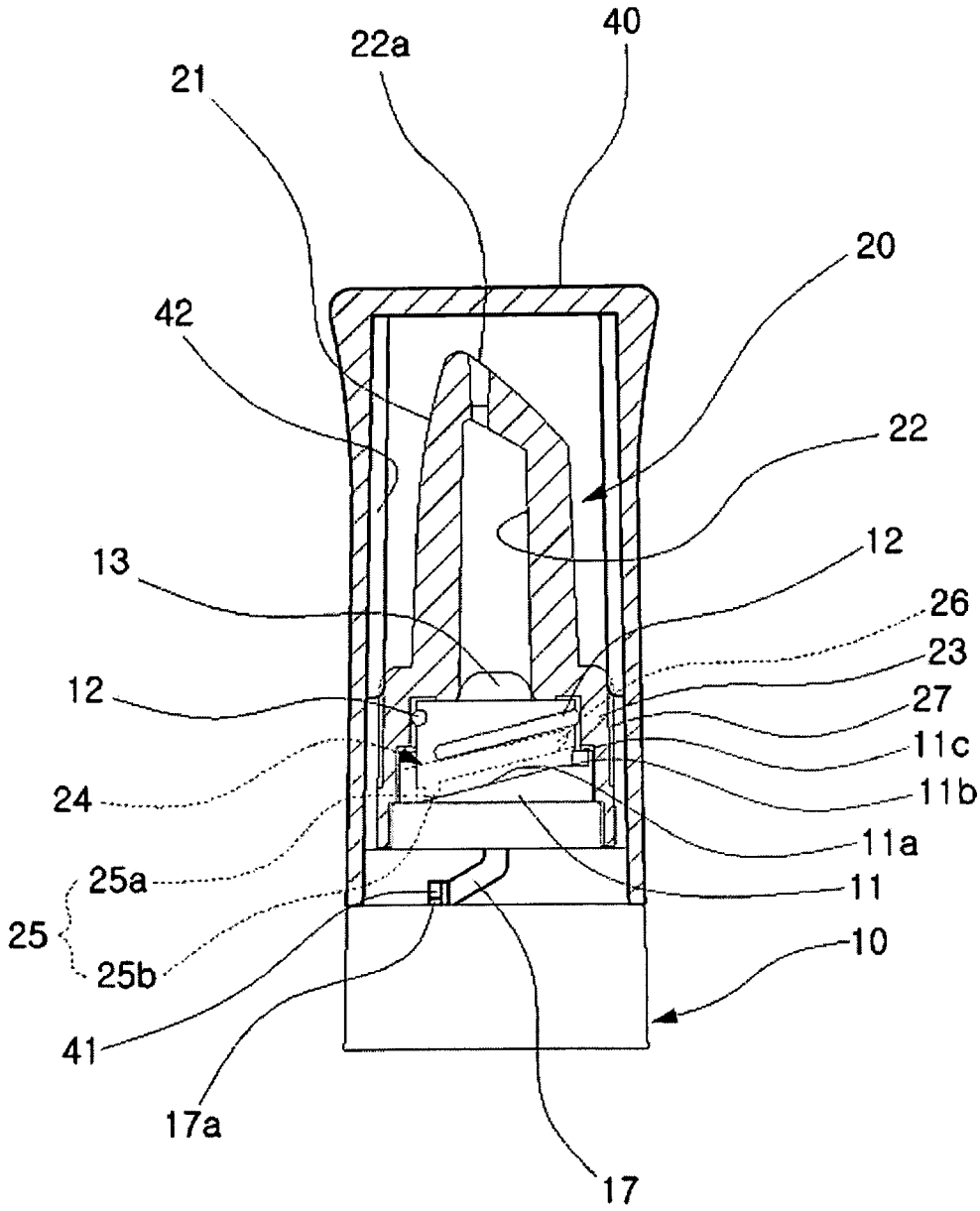
FIG. 8 is a sectional view illustrating the final state of the process that blocks the transmitting path of the nozzle tip 20 in the cosmetic case according to the present invention.
Figure 9:
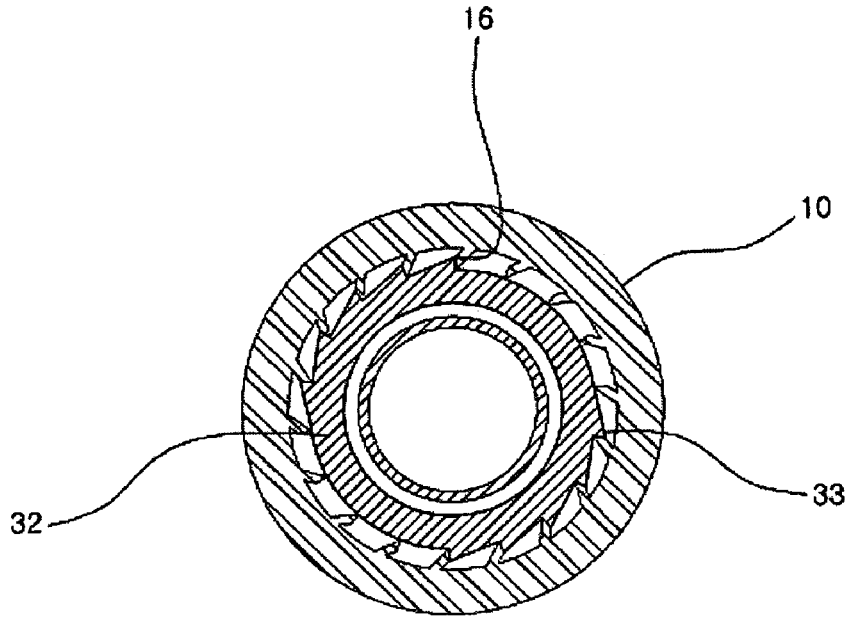
FIG. 9 is a sectional view illustrating the state that an elastic ratchet projection, which is provided on a nozzle tip connecting part, is being supported by the ratchet projection of the cosmetic case according to the present invention.

FIG. 8 shows a sectional view illustrating the final state of the process that the transmitting path of the nozzle tip 20 is blocked in the cosmetic case according to the present invention.

Firstly, the guiding projection 41, which is provided on the inner side of the cap 40, is positioned to the cap closing guiding rail 17, which is provide on the nozzle tip connecting part 20 as shown in FIG. 6.

If the guiding projection 41 is inserted into the cap closing guiding rail 17 after the guiding projection 41 is positioned at the cap closing guiding rail 17, the key projection 42 is inserted into the groove 27, which is provided on the connecting part 23 of the nozzle tip 20.

If the cap 40 is pressed downwardly after the key projection 42 is inserted into the groove 27 of the connecting part 23 of the nozzle tip 20, the cap 40 rotates in the screw-closing direction while the guiding projection 41 of the cap 40 is guided along the cap closing guiding rail 17.

If the cap rotates in the screw-closing direction, the nozzle tip 20, wherein the key projection 42 of the cap 40 is inserted into the groove 27, is moved in accordance with the movement of the cap 40.

The process to block the nozzle tip 20 by the cap 40, which covers the nozzle tip 20, is described in more detail.

If the nozzle tip 20 is rotated in the screw-closing direction as described above, the shorter guiding projection 25*b* of the guiding projection 25 of the elevating rail 24 of the nozzle tip 20, which is placed at the settling side 11*b* of the spiral guiding rail 11 of the nozzle tip connecting part 10, escapes from the setting side 11*b* and elevates downwardly along the tilted guiding side 11*a*.

If the guiding projection 25*b* is guided along the tilted guiding side 11*a*, the nozzle tip 20 is moved downwardly toward the nozzle tip connecting part 10 because the supporting thread 26 of the elevating rail 24 is guided toward the spiral supporting rail 12, which is provided at the upper side of the spiral guiding rail 11.

If the nozzle tip 20 is moved downwardly, the content transmitting path 22 is blocked air tightly because the switching pole 13, which is provided through the rib 14 on the content transmitting path 15 of the nozzle tip connecting part 10, is inserted in to the content transmitting path 22, as shown in FIG. 8.

In the meantime, the state in which the content transmitting path 22 is blocked by the switching pole 13 can be maintained stably because the longer guiding projection 25*a* of the guiding projection 25 of the elevating rail 24 is supported on the ledged side 11*d* of the nozzle tip connecting part 10 and the supporting thread 16 is supported by the spiral supporting rail 12 at the same time.

Because the content transmitting path 22 is blocked air tightly by the switching pole 13, not only leakage of the content while carrying but also intrusion of air can be blocked effectively.

Further the nozzle tip 20 is blocked more stably because the guiding projection 41 of the cap 40, which blocks the nozzle tip 20, is positioned at the locking hole 17*a* of the cap closing guiding rail 17 of the nozzle tip connecting part 10.

As described above, the present invention can discharge the content to be used or block the nozzle tip 20 as the nozzle tip 20 rotates. The present invention can prevent the nozzle tip connecting part 10 from being loosened even though excessive rotating force is applied in the screw-loosening direction because the nozzle connecting part 10 is installed to the container 30 while the elastic ratchet projection 16, which is provided on the inner side of the nozzle tip connecting part 10, is engaged with the ratchet projection 33, which is provided on the opening portion 31 of the container 30.

Figure 10:
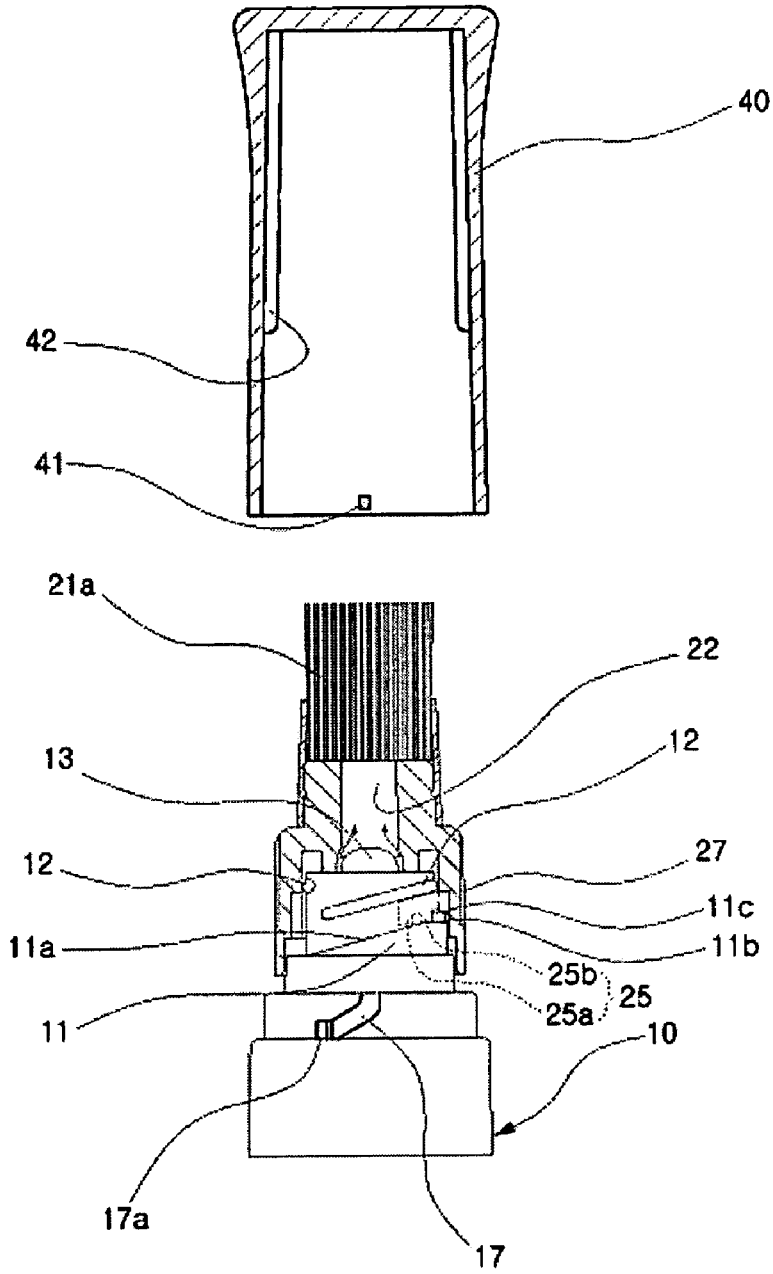
FIG. 10 shows another embodiment of the nozzle in the cosmetic case according to the present invention.

FIG. 10 shows another embodiment of the nozzle tip in the cosmetic case according to the present invention.

In the embodiment shown in FIG. 10, the discharging tube 21 of the nozzle tip 20 is made by one of brush, rubber, TEFLON (trademark of DuPont. Another name for "POLYTETRAFLUOROETHYLENE"), sponge, puff, flocking ball 21*a* so that various needs of customer can be met.

As described above, the present invention can solve the problem that the oily or watery tint-care cosmetic is unnecessarily leaked out and hardened because the content transmitting path 22, which forms the discharging tube 21 of the nozzle tip 20, is blocked air tightly by the movement of the cap 40, which covers the nozzle tip 20, with respect to the switching pole 13, which is provided on the content transmitting path 22 of the nozzle tip connecting part 10, which is connected to the opening portion 31 of the container 30 through the rib so that the content can be discharged through the content transmitting path 22.

Further the present invention can improve credibility and consistency of the product because it can ensure that the user will feel the sense that he/she felt at first purchase without evaporation of the oily or watery component by effectively blocking the content in the container from being contacted with the air.

Still further the present invention can improve productivity in accordance with assembly process because the structure of the nozzle tip is simplified.

Reduction of the cost can be also expected accordingly.

Still further the present invention can improve the durability of the opening portion 31 by installing ratchet projection 33 at the opening portion 31 of the soft tube type container 30.

Still further the present invention can protect the content from becoming harden due to contact with the air or evaporation of the oily or watery component because the elastic ratchet projection 16, which is provided on the connecting part 23 of the nozzle tip 20, is engaged with the ratchet projection 33, which are provided on the opening portion 31, so that loosening cannot happens even if a rotating force in the screw-loosening direction at the installed nozzle tip 20 is applied.

Still further the present invention can protect the content.

Still further the present invention can improve consumer's credibility of the cosmetic case with the nozzle tip because the content is protected from being leaked to lose and the interior of a carrying case is protected from getting dirty as the leaked content sticks to other articles.

What is claimed is:

1. A cosmetic dispenser having a container for a cosmetic, a nozzle tip installed on the container in order to dispense the cosmetic contained in the container;

a nozzle tip connecting part connecting the nozzle tip to the container;

i) the container including:

an opening portion for discharging the contained content, a lower outer circumference portion comprising a thread for threadably engaging the nozzle tip connecting part, and an upper circumference portion comprising a rachet projection;

ii) the nozzle tip connecting part including:

an elastic ratchet projection engageable with the rachet projection of the container to prevent the nozzle tip connecting part from loosening once installed on the container;

a spiral guiding rail on an outer surface for guiding the nozzle tip toward or away from the nozzle tip connecting part;

a spiral supporting rail adjacent the spiral guiding rail;

a lower end comprising a cap closing guiding rail; and a switching pole at an end near the nozzle tip;

iii) the nozzle tip including a discharging tube having a content transmitting path therein and being connected to a discharging hole; said discharging tube having a bottom portion;

a connecting part at the bottom portion of the discharging tube;

an elevating rail being guided along the spiral guiding rail and supported by the spiral supporting rail above the spiral guiding rail, the elevating rail being disposed on the interior side of the connecting part; and a groove on an outer circumference portion; and iv) a cap including a key projection which is insertable into the groove of the nozzle tip; and a guiding projection which can be guided along a cap closing guiding rail of the nozzle tip connecting part.

2. The cosmetic case in claim 1, wherein the discharging tube of the nozzle tip includes a brush, rubber, TEFLON (trademark of DuPont Another name for "POLYTETRAFLUOROETHYLENE"), sponge, puff or flocking ball.

3. A cosmetic dispenser comprising:

a container for storing a cosmetic therein; the container having an opening portion;

a connecting part connected to the opening portion of the container; the connecting part including a switching pole;

a dispensing part connected to the connecting part; the dispensing part including a discharging tube having a lower opening dimensioned to be closed by the switching pole; and a cap removably covering the dispensing part and connectable to the connecting part; wherein the container and the connecting part include means for preventing the connecting part from loosening once the connecting part is installed on the container;

the dispensing part and the connecting part include first cooperating means for supporting and guiding the dispensing part on the connecting part between a closed position in which the switching pole of the connecting part closes the lower opening of the discharging tube of the dispensing part thereby preventing the cosmetic from being transmitted from the container to the dispensing part, and an open position in which the lower opening of the dispensing part is moved away from the switching pole thereby allowing the cosmetic to be transmitted from the container to the dispensing part;

the cap and the dispensing part having second cooperating means for rotating the dispensing part with the cap when a rotational force is applied to the cap to move the dispensing part between the closed and open positions; and the cap and the connecting part having third cooperating means for supporting and guiding the cap on the connecting part.

4. A cosmetic dispenser according to claim 3, wherein the means for preventing the connecting part from loosening includes ratchet projections on an outer portion of the opening portion of the container and on an inner portion of the connecting part.

5. A cosmetic dispenser according to claim 3, wherein the first cooperating means includes a spiral supporting rail and a spiral guiding rail on an outer portion of the connecting part, and an elevating rail on an inner portion of the dispensing part.

6. A cosmetic dispenser according to claim 3, wherein the second cooperating means includes a projection on an inner portion of the cap and a groove on an outer portion of the dispensing part.

7. A cosmetic dispenser according to claim 3, wherein the third cooperating means includes a guiding projection on an inner portion of the cap and a cap closing guiding rail on an outer portion of the connecting part.

8. A cosmetic dispenser according to claim 7, wherein the connecting part further comprises a locking groove at an end of the cap closing guiding rail.

* * * * *